US011719015B2

(12) United States Patent
Haase et al.

(10) Patent No.: US 11,719,015 B2
(45) Date of Patent: Aug. 8, 2023

(54) FENCE SECURING DEVICE

(71) Applicants: Wolfgang Haase, Ebersbach (DE); Deniz Keser, Stuttgart (DE)

(72) Inventors: Wolfgang Haase, Ebersbach (DE); Deniz Keser, Stuttgart (DE)

(73) Assignees: Wolfgang Haase, Ebersbach (DE); FenzFoot GmbH, Stuttgart (DE)

( * ) Notice: Subject to any disclaimer, the term of this patent is extended or adjusted under 35 U.S.C. 154(b) by 796 days.

(21) Appl. No.: 16/577,655

(22) Filed: Sep. 20, 2019

(65) Prior Publication Data

US 2021/0087848 A1 Mar. 25, 2021

(51) Int. Cl.
*E04H 12/22* (2006.01)
*E04H 17/22* (2006.01)

(52) U.S. Cl.
CPC ..... *E04H 12/2238* (2013.01); *E04H 12/2246* (2013.01); *E04H 17/22* (2013.01)

(58) Field of Classification Search
CPC ... E04H 17/009; E04H 17/22; E04H 12/2238; E04H 12/2246; E04H 12/2269; E04H 17/18; E04H 12/2261; E04G 21/3233; E04G 21/3238
USPC ..... 256/65.14; D25/133
See application file for complete search history.

(56) References Cited

U.S. PATENT DOCUMENTS 3,776,521 A * 12/1973 Weinert ..... E04G 21/3233 256/59
5,088,680 A * 2/1992 Farmer ..... E01F 9/692 248/910
5,813,662 A * 9/1998 Langkruis ..... E04H 12/2246 256/25
6,086,285 A * 7/2000 Christensen ..... E01F 9/70 404/6
7,275,888 B1 * 10/2007 Christensen ..... E01F 15/086 404/6
7,338,033 B2 * 3/2008 Anson ..... E01F 9/692 256/65.01

(Continued)

FOREIGN PATENT DOCUMENTS

DE 1946170 1/1966
DE 19652696 6/1998

(Continued)

*Primary Examiner* — Jonathan Liu
*Assistant Examiner* — Guang H Guan
(74) *Attorney, Agent, or Firm* — Reinhart Boerner Van Deuren P.C.

(57) ABSTRACT

Disclosed are embodiments of a fence securing device for fixing two fence elements onto one another. The device includes a body with a bottom side for placing the body on a ground, with a top side facing away from the bottom side and with four lateral surfaces. The body includes a mounting with a mounting opening on the top side for receiving complementary mounting elements of the two fence elements. The mounting opening penetrates the body from the top side to the bottom side. At least one supporting section formed on the body as a single piece with at least one supporting surface is arranged on the top side of the body for supporting the fence elements. The supporting surface of the supporting section faces the at least one mounting opening is arranged in parallel and at a distance to a centre axis of the mounting opening.

1 Claim, 3 Drawing Sheets

(56) References Cited

U.S. PATENT DOCUMENTS

| | | | | |
|---|---|---|---|---|
| 7,588,387 | B1 * | 9/2009 | Christensen | E01F 15/088 404/9 |
| 7,631,409 | B2 * | 12/2009 | Dehlsen | E04H 17/22 29/527.1 |
| 8,366,079 | B2 * | 2/2013 | Stoffels | E01F 13/022 256/65.14 |
| 8,500,110 | B2 * | 8/2013 | Allen | E04F 11/1853 269/297 |
| 8,789,549 | B1 * | 7/2014 | Barnes | E04H 12/2246 135/114 |
| 9,464,452 | B2 * | 10/2016 | Higgs | E04G 21/3238 |
| 9,556,582 | B2 * | 1/2017 | Pelletier | E02D 27/01 |
| 9,863,162 | B2 * | 1/2018 | Whiteley | E04H 12/2238 |
| 10,113,279 | B2 * | 10/2018 | Stevens | E01F 15/088 |
| 10,184,267 | B2 * | 1/2019 | Kuo | E04F 11/1853 |
| 10,731,373 | B2 * | 8/2020 | Lomax | E04H 12/2246 |
| 2018/0266137 | A1 * | 9/2018 | Lomax | E04H 12/2238 |
| 2021/0087848 | A1 * | 3/2021 | Haase | E04H 17/22 |

FOREIGN PATENT DOCUMENTS

| | | | | |
|---|---|---|---|---|
| DE | 202015007021 | | 12/2015 | |
| DE | 202021106246 | U1 * | 12/2021 | E04H 12/2238 |
| FR | 2497919 | A1 * | 7/1982 | E04H 12/2246 |

* cited by examiner

FENCE SECURING DEVICE

FIELD

The invention relates to a fence securing device for fixing two fence elements onto one another.

BACKGROUND

Fence securing devices are already known from prior art and are used to build a fence—for example, a construction barrier fence—compose of a plurality of fence elements. Thereby, the conventional fence securing device comprises a monolithic flat body—as is known from DE 196 52 696 C2 for example—with at least two openings for complementarily shaped mounting elements of the fence elements. For the construction of a fence, adjacent fence elements with a mounting element are arranged in the openings of the fence securing device, thereby being attached to the fence securing device and to each other.

From DE 20 2015 007 021 U1, a fence securing device is also known, by means of which the fence elements can be secured on an uneven ground. For this purpose, two sleeves are formed on a support plate, in which the mounting elements of the fence elements can be fixed. A ground anchor can then fix the support plate to the substrate spaced away and, by means of this, the unevenness of the substrate is evened out. DE 1 946 170 U describes a fence securing device with a monolithic body on which additional supporting section are integrally formed. The fence elements can also be supported on the supporting sections.

High security requirements are placed on the fences built with the fence securing devices. In particular, the individual fence elements should be securely fixed to the ground and to each other. In order to meet the safety requirements, the conventional fence securing devices are made of heavy materials, such as stone or concrete, and the individual fence elements are additionally connected to each other, for example, by means of connecting clamps.

However, with a force acting on the fence elements—for example, a wind power or an impact force—the individual fence elements can be ripped out of the fence securing device so that the risk of a fence crashing down, in particular, onto people—such as for example, passers-by or road users—cannot be ruled out in the case of the fence protection devices known from prior art.

The object of the invention is therefore to provide a fence securing device where the mentioned disadvantages are overcome. In particular, simplified handling and increased stability are strived for.

BRIEF SUMMARY

The task is solved according to the invention by means of present disclosure including as described in the claims. Favourable embodiments are described throughout the present disclosure.

The present invention is based on the general idea of supporting a fence element on a fence securing device, thereby making a secure fixing of the fence element on the fence securing device possible. The fence securing device for fixing two fence elements to each other thereby comprises a body with a bottom side for placing the body onto a ground, with a top side facing away from the bottom side and with four lateral surfaces. The body comprises a mounting on the top side with at least one mounting opening for receiving complementary mounting elements of the two fence elements, wherein the respective mounting opening penetrates the body from the top side to the bottom side. According to the invention, at least one supporting section designed on the body as a single piece with at least one supporting surface is arranged for supporting the fence elements. According to the invention, the supporting surface of the supporting section faces the at least one mounting opening and is arranged in parallel and at a distance to a centre axis of the mounting opening.

Thus, for the construction of a fence, the body of the fence securing device with the bottom side is placed on the ground and the fence element is arranged on the fence securing device by means of the mounting. Thereby, the mounting element of the fence element is fixed in the mounting opening of the mounting and thus on the fence securing device. The supporting section of the fence securing device faces the mounting opening with the supporting surface so that the fence element can be supported on the supporting surface across a large area during the impact of a force, for example, a wind force or an impact force. An additional support of the fence element on supporting surface makes a secure fixing of the fence element on the fence securing device, whereby the risk of a fence crashing down is favourably reduced during the impact of a force.

Thereby, the body can be cuboid or flat, for example, in order to make a large-area contact and thereby, a better adhesion of the body to the ground possible. The body can also comprise fixing openings, which penetrate the body from the top side to the bottom side and make an additional fixing of the body to the ground possible, for example, by means of an anchor. In addition or as an alternative, the bottom side of the body can, for example, comprise a coating or an adhesion pattern in order to improve the adhesion of the body to the ground.

According to the invention, the supporting section is formed on the top side of the body as a single piece along with the supporting surface of the mounting opening, consequently facing the fence element fixed within the mounting opening. The supporting surface of the supporting section is arranged parallel to and at a spacing away from the centre axis of the mounting opening. Expediently, the spacing of the supporting surface to the centre axis of the mounting opening is selected in such a way that the fence element arranged in the fence securing device abuts the supporting surface at least in sections or can be arranged spaced away from the supporting surface, for example, at a few millimetres. In this way, the fence element can be supported on the supporting surface during the impact of a force and, however, in the case of a fence construction, it can be arranged within the mounting opening without tilting in an effort-reduced manner.

In order to support the fence element on the supporting surface across the largest area possible, the supporting section can extend across the entire width of the body, for example, in parallel to one of the lateral surfaces of the body and the fence element can be supported on the supporting surface across a large area. The supporting section can also taper from the top of the body towards the supporting surface so that, on the one hand, the manufacturing material can be saved, and, on the other hand, the supporting section can have a sufficient level of stability.

Due to the fence securing device according to the invention, a secure fixing of the individual fence elements to the fence securing device can be achieved and the risk of a fence crashing down due to the impact of a force is favourably reduced.

In the case of a favourable further embodiment of the solution according to the invention, it is provided that the mounting comprises two mounting openings arranged spaced away from one another for receiving the respective complementary mounting elements of the fence elements. In this way, the respective mounting element can be arranged in the respective mounting opening so that a secure fixing of the individual fence element in the body is achieved. The spacing between the mounting openings to each other can be adapted to the dimensions of the fence elements to allow for an additional fixing of the fence elements to each other, for example, by means of connecting clamps. In order to be able to support the two fence elements arranged in the mounting openings on the supporting surface, the supporting surface is arranged in parallel to and spaced away from the centre axes of the two mounting openings. The spacing of the supporting surface to the centre axes of the respective mounting openings can be adapted for the effort-reduced fixing of the fence elements on the fence securing device.

Favourably, it is provided that the two mounting openings are arranged equally spaced away from the two opposite lateral surfaces of the ground plate or from the two lateral surfaces of the ground plate respectively lying next to one other. In this way, the fence securing device can, on the one hand, absorb the forces exerted by the two fence elements on the fence securing device evenly and, on the other hand, a fence structure with such a symmetrically designed fence safety device can be simplified.

In order to further improve a support of the fence elements in the fence securing device, it is favourably provided that the body comprises at least two supporting sections, wherein the supporting sections on both sides are arranged at the at least one mounting opening opposite each other. The supporting surfaces of the supporting sections are spaced away and arranged facing each other. Thereby, the spacing of the supporting surfaces of the respective supporting sections to one another can be adapted in such a way that the fence elements can be arranged in the fence securing device without tilting and, however, still be able to be supported on the supporting surfaces during the impact of a force. In order to make a support possible across a large area, the two supporting sections can extend across an entire width of the body, for example, parallel to one of the lateral surfaces of the body. In the case of this favourable embodiment of the fence securing device, the fence elements can be supported across a large area in two opposite directions, whereby the risk of a fence crashing due to the impact of a force can be favourably minimized.

Favourably, it is furthermore provided that the body comprises a bridge section, which connects the supporting surfaces facing each other of the supporting sections to one another. The bridge section can, for example, be arranged between the two fence elements fixed in the fence securing device, thereby forming an additional supporting surface for the two fence elements into a transverse direction to the two supporting surfaces. In this way, a supporting of the fence elements in the fence securing device can additionally be improved. Due to the bridge section, the spacing between the two supporting surfaces away from each other can also favourably be determined and an undesired change of the spacing between the supporting surfaces, for example, due to a usage, can be avoided. In order to stabilize the supporting sections in a particularly effective way, the bridge section can extend to the top side of the body. It is also provided that the bridge section can extend until the bottom side of the body and the two mounting openings of the mounting can be separated from each other.

In a further embodiment of the fence securing device according to the invention, it is favourably provided that the fence securing device is designed in the form of a hollow body with a cavity and that the fence securing device comprises an inlet device and an outlet device, which are connected to the cavity of the hollow body of the fence securing device in a material-transferring manner. The hollow body can be filled with a material—such as sand—via the inlet device in the case of a fence construction and emptied again via the outlet device in the case of a fence removal. In this way, the fence securing device can be transported and stored in an effort/cost-reduced manner.

In order to be able to also fill the hollow body with fluids, it is favourably provided that a filling container is arranged in the cavity of the hollow body. The filling container is connected to the inlet device and to the outlet device in a material-transferring manner, and is fluid-tight. In this way, the filling container can be filled with a fluid, such as water for example. Favourably, in a filled state, the fence securing device can weigh up to 120 kg or more, and the fence securing device can be steadfastly fixed to the ground. In an emptied state, the fence securing device can be transported and stored in an effort/cost-reduced manner.

The fence securing device can favourably be made of a metal or a metal alloy or a plastic.

Favourably, it is provided that the fence securing device comprises at least one closure element, by means of which one of the fence elements can be fixed to the fence securing device. In this way, the closure element can be arranged on the fence securing device in such a way that the fence element arranged in the fence securing device is fixed upwardly. The closure element can, for example, be a slider, which can be laterally displaced during fence construction and an arrangement of the fence elements within the fence securing device is made possible. Then, the closure element can be shifted back, and the respective fence element can be fixed within the fence securing device.

Furthermore, it is provided that the fence securing device comprises at least one warning element. The warning element can, for example, assume an informing, a warning or also a trip-protection function in order to design the fence securing device to be particularly safe for passers-by or road users. The warning element can, for example, comprise LEDs (light emitting diodes) or a fluorescent strip or a reflective strip.

Other important features and advantages of embodiments of the invention are described in relation to the claims, the drawings, and the related figure description based on the figures.

It is to be understood that the features explained in the aforementioned and following cannot only be used in the respectively indicated combination, but also in other combinations or alone, without departing from the scope of the present invention.

Preferred exemplary embodiments of the invention are represented in the figures and will be described in more detail in the following description, wherein the same reference numbers will refer to the same or similar or functionally identical components.

BRIEF DESCRIPTION OF THE DRAWING

On a schematic level respectively, the figures show.

DETAILED DESCRIPTION

Figure 1:
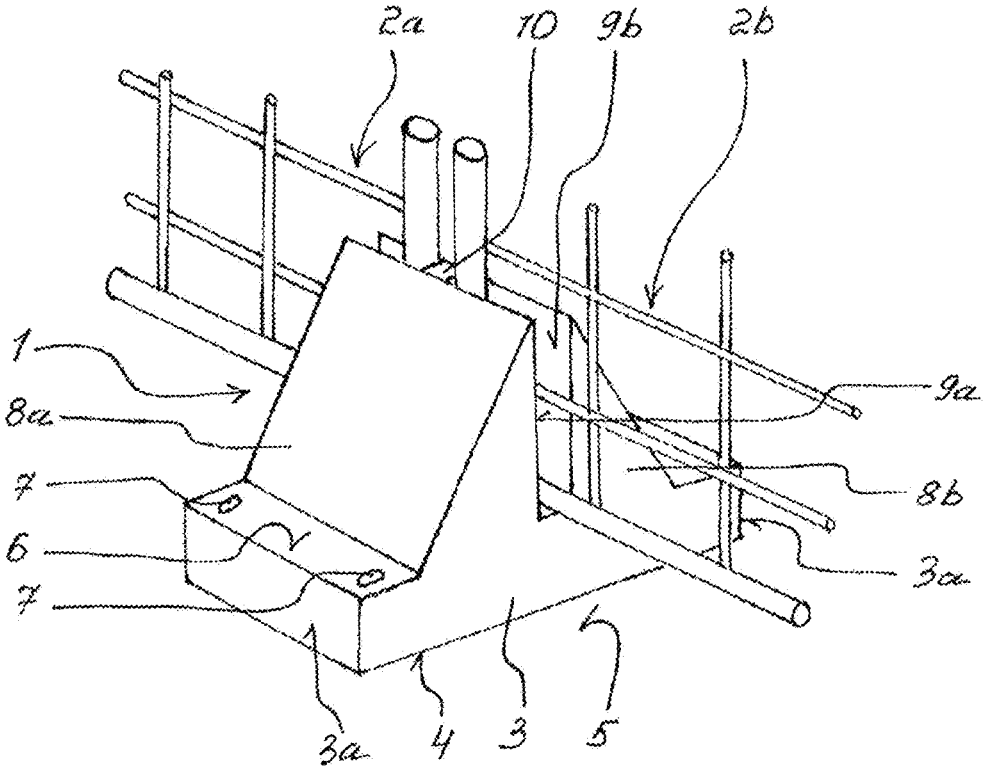
Fig. 1 Prior Art
FIG. 1 is a view of a conventional fence securing device.

FIG. 1 to FIG. 4 show views of a fence securing device 1 for fixing two fence elements 2*a* and 2*b* onto one another. Thereby, the fence securing device 1 comprises a body 3 with a bottom side 4 for placing the body 3 on a ground 5 and with a top side 6 facing away from the bottom side 4. The body 3 is cuboid and flat in order to make a better adhesion of the body 3 to the ground 5 possible. Additionally, the body comprises fixing openings 7, which penetrate the body 3 from the top side 6 to the bottom side 4 and make an additional fixing of the body 3 to the ground 5 possible, for example, by means of an anchor.

The body 3 comprises two supporting sections 8*a* and 8*b* designed on the body 3 as a single piece on the top side 6, wherein the supporting sections 8*a* and 8*b* each have a supporting surface 9*a* and 9*b* for supporting the fence elements 2*a* and 2*b*. The supporting sections 8*a* and 8*b* extend across an entire width of the body 3 parallel to one of the lateral surfaces of the body 3 and the two fence elements 2*a* and 2*b* can be supported on the supporting surfaces 9*a* and 9*b* across a large area. The supporting sections 8*a* and 8*b* taper from the top side 6 of the body 3 and towards the supporting surfaces 9*a* and 9*b* and are fixed to one another by a bridge section 10.

Figure 2:
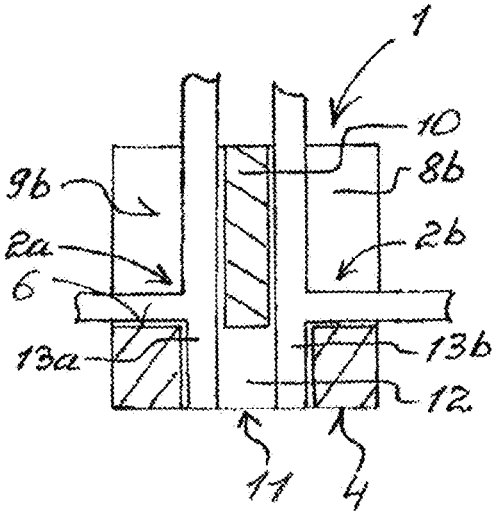
FIG. 2 is a sectional view through a fence securing device with a mounting.
Figure 3:
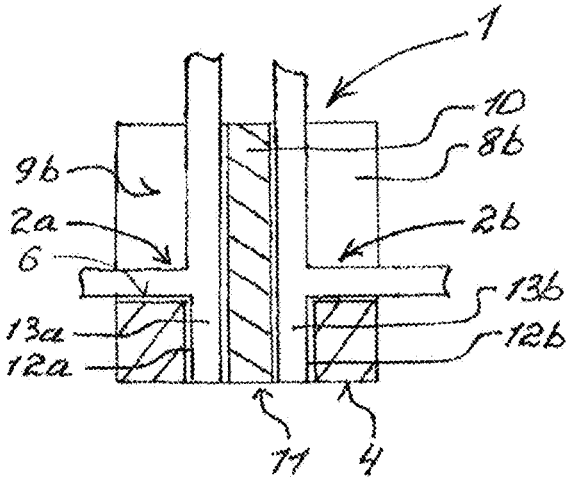
FIG. 3 is a sectional view through a fence securing device with an alternatively designed mounting.

FIG. 2 and FIG. 3 show sectional views through the fence securing device 1 with an alternatively designed mounting 11 respectively. The mounting 11 is arranged on the top side 6 of the body 3 and comprises a mounting opening 12—as is shown in FIG. 2—or, as an alternative, two mounting openings 12*a* and 12*b*—as is shown in FIG. 3. The mounting openings 12, 12*a* and 12*b* penetrate the body 3 from the top side 6 to the bottom side 4 and mounting elements 13*a* and 13*b* of the fence elements 2*a* and 2*b* are designed to be complementary. The bridge element 10 separates the two fence elements 2*a* and 2*b* and, in FIG. 3, also the mounting openings 12*a* and 12*b* from one another.

Figure 4:
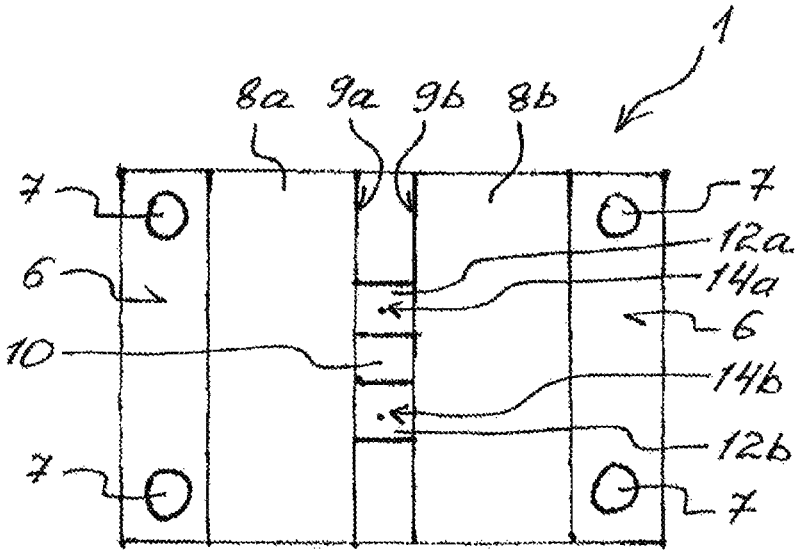
FIG. 4 is a top view of a fence securing device.

In FIG. 4, a top view of the fence securing device 1 is shown. The bridge section 10 is attached to the supporting surfaces 9*a* and 9*b* of the respective supporting sections 8*a* and 8*b*. The supporting surfaces 9*a* and 9*b* are arranged in parallel and at a distance to the centre axes 14*a* and 14*b* of the mounting openings 12*a* and 12*b*. Thereby, the spacing of the supporting surfaces 9*a* and 9*b* away from one another are adapted in such a way that the fence elements 2*a* and 2*b* can be arranged in the fence securing device 1 without tilting and, however, the fence elements 2*a* and 2*b* can be supported on the supporting surfaces 9*a* and 9*b* in opposing directions during the impact of a force, for example a wind force or an impact force.

Figure 5:
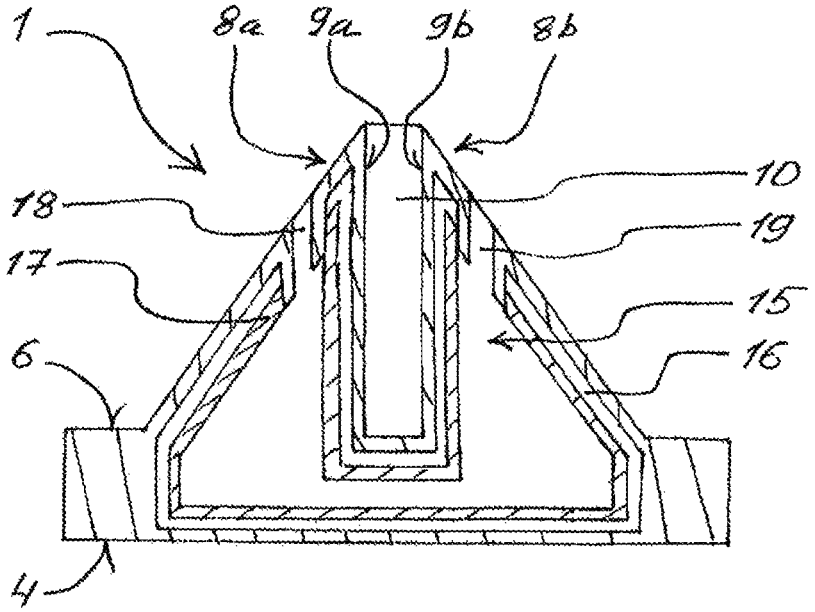
FIG. 5 is a sectional view through a fence securing device with a hollow body.

FIG. 5 shows a sectional view through the fence securing device 1 with a hollow body 15. The hollow body 15 comprises a cavity 16, in which a fluid-tight filling container 17 is arranged. The filling container 17 is connected to an inlet device 18—for example, an inlet valve—and to an outlet device 19—for example, an outlet valve—in a material-transferring manner so that the filling container 17 is filled with a substance—such as water for example—via the inlet device 18 and can be emptied again via the outlet device 19 when dismantling. The filling container 17 can, for example, be made of plastic and the hollow body 15 can be made of a metal or out of a metal alloy or out of a plastic for example.

Figure 6:
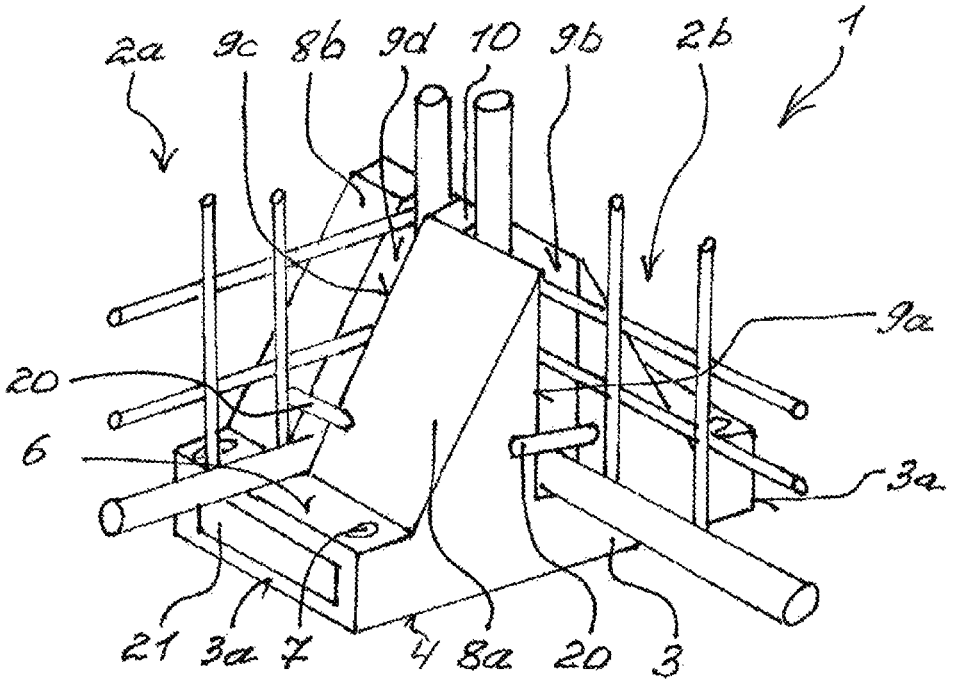
FIG. 6 is a view of an alternatively designed fence securing device.

FIG. 6 shows the alternatively designed fence securing device 1 with the supporting sections 8*a* and 8*b*. The supporting section 8*a* comprises the supporting surface 9*a*, which faces the mounting opening 12*b* and is arranged in parallel and at a distance to the centre axis 14*b* of the mounting opening 12*b*. Thereby, the supporting section 8*a* also has a supporting surface 9*c*, which is arranged facing the mounting opening 12*a*. The supporting section 8*b* comprises the supporting surface 9*b* and another supporting surface 9*d*. The supporting surfaces 9*c* and 9*d* face the mounting opening 12*a* and are arranged in parallel and at a distance to the centre axis 14*a* of the mounting opening 12*a*. In an alternatively designed fence securing device 1, the fence elements 2*a* and 2*b* can be arranged in mounting openings 12*a* and 12*b* at an angle of 90°.

The fence securing device 1 furthermore comprises closure elements 20, via which the fence elements 2*a* and 2*b* can be fixed upwardly within the fence securing device 1. During fence construction, the closure elements 20 can be detached from the fence securing device 1 or laterally displaced so that the fence elements 2*a* and 2*b* can be arranged in the fence securing device 1. Then, the closure elements 20 can be fixed to the fence securing device 1 and, in this way, the fence elements 2*a* and 2*b* can be fixed upwardly within the fence securing device 1. The closure elements 20 can be designed differently, thereby deviating from this exemplary embodiment—for example, as a clamp or a slider.

In order to design the fence securing device 1 to be particular safe for passers-by or for road users, the fence securing device 1 comprises a warning element 21 on one of the lateral surfaces 3*a*. The warning element 21 can, for example, assume an informing function for passers-by or road users and inform them of the nearest emergency exit for example. Favourably, the respective warning element 21 can comprise LEDs (light emitting diodes) or a fluorescent strips or reflective strips so that a warning and trip-protection function can be additionally assumed by the fence securing device 1 in the dark.

Figure 7:
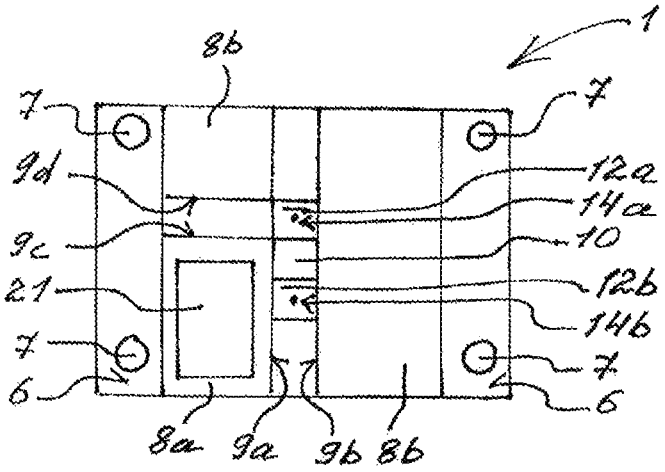
FIG. 7 is a top view of an alternatively designed fence securing device.

FIG. 7 shows a top view of an alternatively designed fence securing device 1. The fence elements 2*a* and 2*b* can be arranged in the fence securing device 1 at an angle of 90°. The warning element 21 is arranged on the supporting section 8*a* in this exemplary embodiment.

Due to the fence securing device 1 according to the invention, a secure fixing of the individual fence elements 2*a* and 2*b* to the fence securing device 1 can be achieved and the risk of a fence crashing down due to the impact of a force is favourably reduced.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A fence securing device for fixing two fence elements onto one another, wherein the fence securing device comprises a body with a bottom side for placing the body on a ground, with a top side facing away from the bottom side and with four lateral surfaces, and wherein the body comprises at least one mounting with at least one mounting opening on the top side for receiving complementary mounting elements of the two fence elements, and wherein the at least one mounting opening penetrates the body from the top side to the bottom side, wherein at least one supporting section formed on the body as a single piece with at least one supporting surface is arranged on the top side of the body for supporting the two fence elements, and the at least one supporting surface of the at least one supporting section faces the at least one mounting opening and is arranged in parallel and at a distance to a centre axis of the at least one mounting opening, wherein, the fence securing device is designed in the form of a hollow body with a cavity and the fence securing device comprises an inlet device and an outlet device, which are connected to the cavity in a material transferring manner, wherein the at least one supporting section comprises a first supporting section and a second supporting section, wherein the at least one supporting surface comprises a first supporting surface of the first supporting section and a second supporting surface of the second supporting section, wherein the first supporting section and the second supporting section are both arranged at the at least one mounting opening and are arranged opposite to one another and wherein the first and second supporting surfaces of the first and second supporting sections are arranged spaced away and facing one another, wherein the fence securing device comprises a bridge section which connects the first and second supporting surfaces of the first and second supporting sections to one another, and wherein the at least one mounting opening comprises two mounting openings, the bridge section extends up to the bottom side of the body and the two mounting openings are separated from one another.

* * * * *